United States Patent [19]

Nanjyo et al.

[11] Patent Number: 4,669,436

[45] Date of Patent: Jun. 2, 1987

[54] ELECTRONIC GOVERNOR FOR AN INTERNAL COMBUSTION ENGINE

[75] Inventors: Hirotoshi Nanjyo; Hidetoshi Suzuki, both of Shizuoka, Japan

[73] Assignee: Kokusan Denki Co. Ltd., Mumazu, Japan

[21] Appl. No.: 886,042

[22] Filed: Jul. 16, 1986

[30] Foreign Application Priority Data

Jul. 18, 1985 [JP] Japan ..... 60-157000

[51] Int. Cl.[4] ..... F02M 39/00

[52] U.S. Cl. ..... 123/357; 123/359

[58] Field of Search ..... 123/357, 358, 359

[56] References Cited

U.S. PATENT DOCUMENTS

| | | | |
|---|---|---|---|
| 4,493,302 | 1/1985 | Kawamura | 123/357 |
| 4,509,480 | 4/1985 | Kull | 123/359 |
| 4,515,125 | 5/1985 | Bock | 123/359 |
| 4,566,414 | 1/1986 | Sieber | 123/357 |
| 4,603,668 | 8/1986 | Ueno | 123/357 |

*Primary Examiner*—Carl Stuart Miller

*Attorney, Agent, or Firm*—Pearne, Gordon, McCoy & Granger

[57] ABSTRACT

In an electronic governor for an internal combustion engine provided with a fuel injection pump having a control rack for adjusting fuel supply, an accelerator position signal Vs and a speed detection signal Vn are inputted into a speed deviation operation circuit for producing a speed deviation signal, which is integrated by an intergrator. The integral signal from the integrator is used for controlling the rack. The integral signal is also inputted into a droop operation circuit producing a droop factor signal Va whose magnitude is proportional to the intergral signal. The speed deviation operation circuit produces, as the speed deviation signal, a signal corresponding to Vn−(Vs+Va) or Vn−(Vs−Va).

3 Claims, 7 Drawing Figures

ELECTRONIC GOVERNOR FOR AN INTERNAL COMBUSTION ENGINE

BACKGROUND OF THE INVENTION

The present invention relates to an electronic governor for an internal combustion engine for controlling the rotational speed of the internal combustion engine by controlling a control rack of a fuel injection pump.

In an internal combustion engine, such as a diesel engine where fuel is supplied by a fuel injection pump, the rotational speed (rpm) is controlled by controlling the position of a control rack (fuel injection amount adjustment member).

An example of an electronic governor for controlling the rotational speed by controlling the position of the rack of the fuel injection pump for use in an internal combustion engine is shown in Japanese Patent Application Laying-open No. 171037/1982. In this prior art electronic governor, a rotational speed detection signal obtained from a sensor for detecting the rotational speed of the engine, a rack position detection signal obtained from a sensor detecting the position of the rack of the fuel injection pump, and an accelerator position detection signal obtained from a sensor for detecting the position of the accelerator manipulator are used to calculate the target position of the rack required to obtain the desired rotational speed of the engine as indicated by the accelerator position. A control voltage required for positioning the rack at the target position is generated and is used to drive an actuator for actuating the rack, thereby moving the rack to the target position.

In an internal combustion engine with a prior art governor which determines the manipulated variable from a rack position detection signal, the characteristic curve showing the variation of the rotational speed against the load factor (=actual load/rated load) d droops, i.e., it exhibits a drop characteristic. The degree of drooping is expressed in terms of droop factor D defined by $$D=\{(N1/N2)-1\}\times 100\% \quad (1)$$

where N1 represents the rotational speed for the load factor of 0%, and

N2 represents the rotational speed for the load factor of 100%.

The term "droop characteristic" is generally used to refer to the characteristic in which the rotational speed decreases with increasing load factor. But, in this specification, the term "droop characteristic" encompasses not only the characteristic of decreasing rotational speed with increasing load factor but also the characteristic of increasing rotational speed with decreasing load factor.

Different droop factors are preferred or required depending on the application of the internal combustion engine. For instance, when the constant speed control by which the rotational speed is kept constant against load variation is to be effected the droop factor needs to be zero.

But with the prior art governor, if the difference between the rotational speed N2 for the load factor of 100% and the rotational speed N1 for the load factor of 0% is very small, the gain of the control system is too large and the engine rotational speed is unstable. For this reason, the droop factor cannot be freely selected.

Moreover, with the prior art system, a rack position sensor for detectin the position of the rack is required for controlling the rotational speed. The system is therefore complicated.

SUMMARY OF THE INVENTION

An object of the invention is to provide an electronic governor for an internal combustion engine by which the rotational speed can be controlled without any sensor for detecting the rack position and by which the droop characteristic can be freely selected and can be set at zero.

According to the invention, there is provided an electronic governor for an internal combustion engine provided with a fuel injection pump for supplying fuel to the engine and having a control rack for adjusting fuel injection amount, said electronic governor comprising, means providing an accelerator position signal Vs indicative of the desired rotational speed No of the internal combustion engine, a speed detector detecting the actual rotational speed N of the internal combustion engine and producing a speed detection signal Vn indicative of the rotational speed N, a speed deviation operation circuit responsive to the accelerator position signal Vs and the speed detection signal Vn for producing a speed deviation signal Vnd, an integrator for integrating the speed deviation signal, means responsive to the output of the integrator for controlling the rack, and a droop operation circuit responsive to the output of the integrator for producing a droop factor signal Va whose magnitude is proportional to the output of the integrator, said speed deviation operation circuit producing, as said speed deviation signal, a signal corresponding to the difference Vn−(Vs+Va) or Vn−(Vs−Va) between the speed detection signal Vn and either the sum (Vs+Va) of or the difference (Vs−Va) between the accelerator position signal Vs and the droop factor signal Va.

With the above arrangement, the integrator integrates the deviation signal to produce the integral signal corresponding to $$K\int\{Vn-(Vs+Va)\}dt, \text{ or}$$

$$K\int\{Vn-(Vs-Va)\}dt,$$

where K is an integral constant. The rack control means controls the rack in accordance with this integral signal, to cause the deviation of the actual rotational speed of the engine from the designated rotational speed to be within the permissible range including zero. The control is continued to make the speed deviation smaller. The integrator holds the integral value at the time when the speed deviation becomes substantially zero.

The droop factor signal Va for the load factor 0% is larger than the droop factor signal Va for the load factor 100%. Accordingly, if the Vno is determined by $$Vs+Va,$$

the droop characteristic of decreasing rotational speed with increasing load factor is obtained. If the designated speed signal is determined by $$Vs-va,$$

the droop characteristic of increasing rotational speed with increasing load factor is obtained. The droop factor of the droop characteristic can be changed by changing the magnitude of the droop factor signal Va. If Va is set at 0, the droop factor is zero, so that the constant speed characteristic in which the rotational speed is kept constant against load variation can be obtained.

DETAILED DESCRIPTION OF THE PREFERRED EMBODIMENTS

Figure 1:
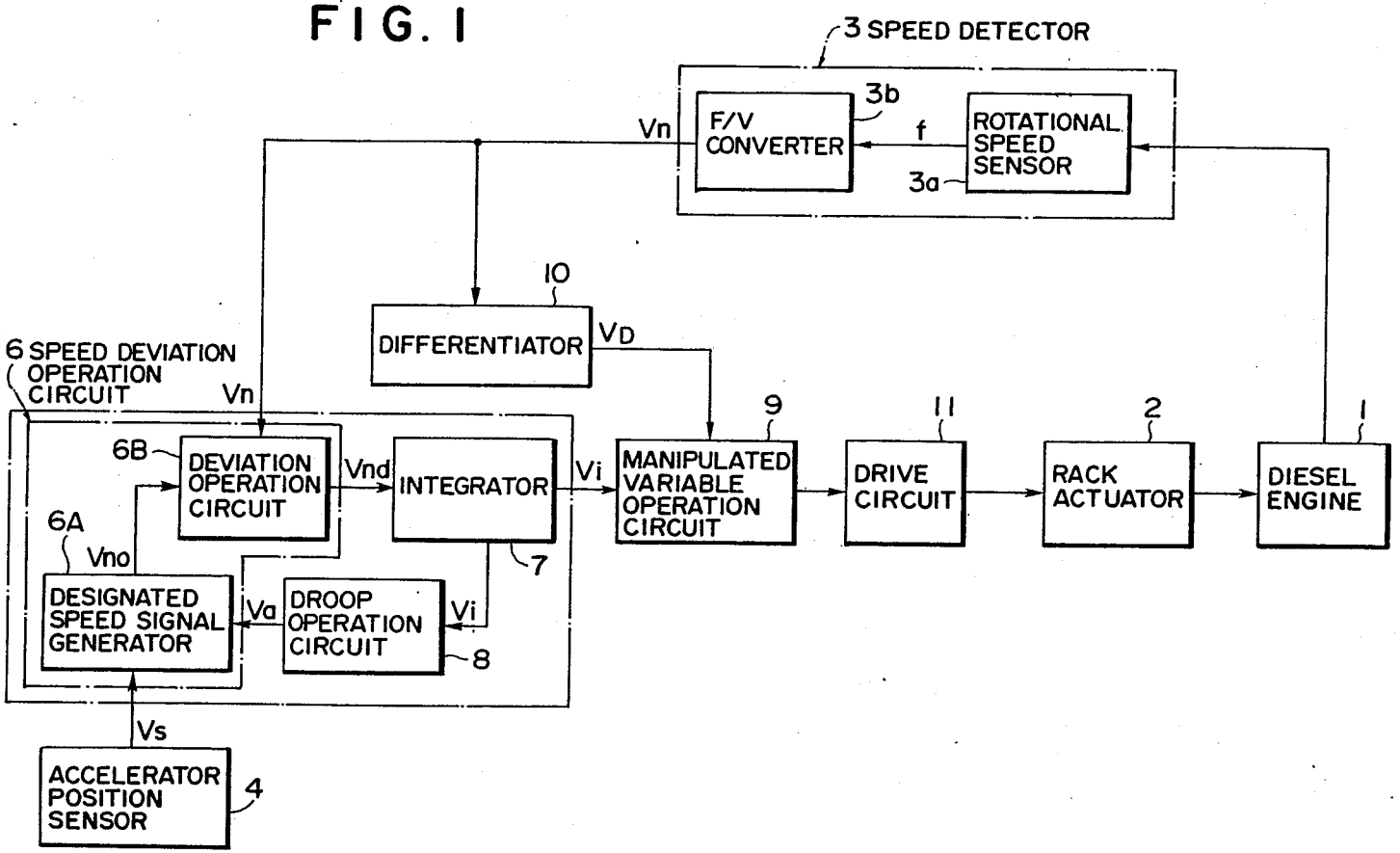
FIG. 1 is a block diagram showing an embodiment of an electronic governor according to the invention.

Referring now more particularly to FIG. 1, there is shown an embodiment of an electronic governor according to the invention. The electronic governor is for an internal combustion engine, which in this embodiment is a diesel engine. The internal combustion engine is provided with a fuel injection pump having a control rack for adjusting the fuel injection amount.

A rack actuator 2 is electrically driven to actuate the rack. The rack actuator 2 may be of the type having an electric motor as a driver or of the type having an electromagnetic plunger as a driver.

A rotational speed sensor 3*a* detects the engine rotational speed, and may comprise a pulse generator whose output frequency is proportional to the engine rotational speed. A frequency-voltage converter (F/V converter) 3*b* converts the output frequency of the sensor 3*a* into a voltage signal Vn, called a speed detection signal, proportional to the engine rotational speed. The rotational speed sensor 3*a* and the F/V converter 3*b* in combination form a speed detector 3.

An accelerator position sensor 4 detects the position of the accelerator manipulator designating the rotational speed of the engine 1, and produces an accelerator position signal indicating the accelerator manipulator position.

The accelerator position signal Vs and a droop factor signal Va, to be described later, are inputted into a designated speed signal generator 6A, which outputs either the sum (Vs+Va) of or the difference (Vs−Va) between the accelerator position signal Vs and the droop factor signal Va, as a designating speed signal Vno.

To obtain a droop characteristic in which the rotational speed decreases with increasing load factor, the sum (Vs+Va) is used as the designated speed signal Vno. To obtain a droop characteristic in which the rotational speed increases with increasing load factor, the difference (Vs−Va) is used as the designated speed signal Vno.

The designated speed signal Vno and the speed detection signal Vn are inputted into a deviation operation circuit 6B, which produces, responsive to the signals Vno and Vn, a constant speed control signal Vnd, in accordance with:

$$Vnd=a(Vn-Vno)$$

where a is a constant.

An integrator integrates the speed deviation signal Vnd to determine the integral value Vi of the speed deviation $$K\int\{Vn-(Vs+Va)\}dt. \text{ or}$$

$$K\int\{Vn-(Vs+Va)\}dt.$$

The integral signal Vi from the integrator 7 is inputted into a droop operation circuit 8 and a manipulated variable operation circuit 9.

The droop operation circuit 8 receives the integral signal Vi and determines a droop factor signal Va in accordance with $$Va=c\times Vi$$

where c is a predetermined constant (which may be zero). The droop operation circuit 8 outputs the thus determined droop factor signal Va.

A differentiator 10 differentiates the speed detection signal Vn. The output of the differentiator 10, i.e., a differential signal VD is also inputted into the manipulated variable operation circuit 9.

The manipulated variable operation circuit 9 determines a manipulated variable for the rack actuator 2 to cause the deviation of the actual rotational speed from the designated rotational speed to be within a permissible range, i.e., to make Vn approximately equal to Vno. The signal indicative of the manipulated variable is inputted into a drive circuit 11, which drives the rack actuator 2 in accordance with the manipulated variable as determined by the manipulated variable operation circuit 9, to move the rack in the appropriate direction so as to cause the actual rotational speed to be closer to the designated rotational speed.

Figure 5:
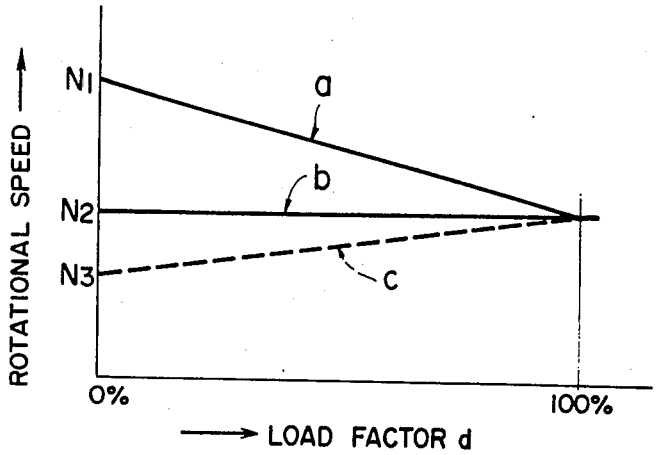
FIG. 5 is a graph showing a relationship between the load factor and the rotational speed of the engine.

It is assumed that the droop characteristic, as shown by the curve a in FIG. 5, in which the rotational speed decreases with increasing load factor d is to be obtained. In this case, the designated speed signal generator 6A produces the sum (Vs+Va) of the accelerator position signal Vs and the droop factor signal Va, as the designated speed signal Vno.

It is assumed that, when the load factor is 0%, the output of the integrator 9 is Vi(0) and the engine is operated stably at Vn=Vno. If the load is connected, the engine rotational speed falls, so that Vn<Vno. This speed vaiationre results in, at first, the differential signal Vd. The manipulated variable operation circuit 11 outputs, responsive to the differential signal VD, a signal to drive the rack actuator 2 in a direction to compensate the speed variation. Thus, the speed compensating operation is started. Responsive to the decrease in the engine rotational speed, the manipulated variable operation circuit 9 also determines the manipulated variable for the rack actuator 2 to cause the deviation of the engine rotational speed N from the designated rotational speed No to be smaller. The drive circuit 12 drives the rack actuator 2 in accordance with the manipulated variable to make the engine rotational speed N approach the designated rotational speed No. The integrator 9 holds the integral signal output produced at the time when Vn becomes approximately equal to Vno.

According to the invention, the integral signal Vi is inputted into the droop operation circuit 8, by which the droop factor Va is determined in accordance with $$Va = c \times Vi$$

(where c is a constant)

and is fed back to the designated speed signal generator 6A to produce the designated speed signal Vno in accordance with $$Vno = Vs + Va.$$

Figure 6:
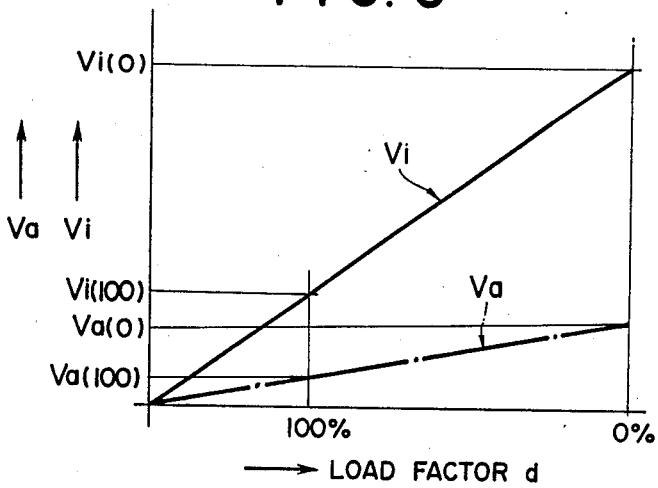
FIG. 6 is a graph showing a characteristic of the integral signal and the droop factor signal against the load factor.

As is shown in FIG. 6, the droop factor signal Va(0) for the load factor of 0% is larger than the droop factor Va(100) for the load factor of 100%. If, therefore, the designated speed signal Vno is determined in accordance with $$Vno = Vs + Va,$$

the designated speed signal Vno decreases with increasing load factor, so that the droop characteristic of decreasing rotational speed with increasing load factor is obtained. The droop factor D can be freely selected by changing the magnitude of the droop factor signal Va. If Va=0, the droop factor D is zero, so that the constant speed characteristic, as shown by the curve b in FIG. 5, by which the rotational speed is kept constant against load vartiation is obtained.

To obtain the droop characteristic as shown by the curve c in FIG. 5 in which the rotational speed increases with increasing load factor d, the designated speed signal generator 6A outputs the difference (Vs−Va) between the accelerator position signal Vs and the droop factor signal Va, as the designated speed signal Vno. In this case, the droop characteristic in which the rotational speed increase with increasing load factor is obtained. The droop factor of the droop characteristic can be freely selected by changing the magnitude of the droop factor signal Va.

Figure 2:
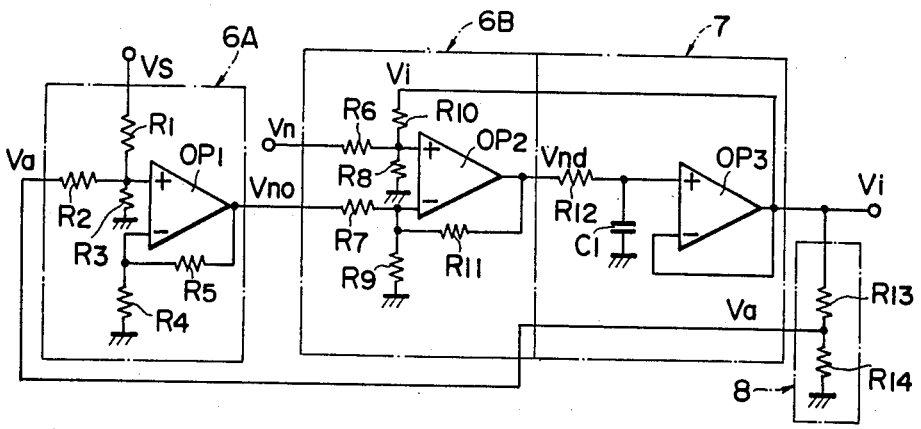
FIGS. 2–4 are circuit diagrams showing examples of the speed deviation operation circuit, the integrator and the droop operation circuit.

Examples of the circuits within the chain line in FIG. 1 will now be described with reference to FIGS. 2-4. FIG. 2 shows an example of the circuits which can be used to obtain the droop characteristic of decreasing rotational speed with increasing load factor. In this example, the designated speed signal generator 6A is formed of an adder comprising an operational amplifier OP1 and resistors R1-R5, and the deviation operation circuit 6B is formed of an operational amplifier OP2 and resistors R6-R11. The integrator 7 is formed of an resistor R12, an integrating capacitor C1 and an operational amplifier OP3 connected to form a buffer amplifier. The droop operation circuit 8 is formed of resistors R13 and R14.

The designated speed signal generator 6A adds the accelerator position signal Vs and the droop factor signal Va to determine the designated speed signal Vno. The deviation operation circuit 6B receives the speed detection signal Vn, the designated speed signal Vno and the integral signal Vi, and determines the speed deviation signal Vnd in accordance with $$Vnd = Vi + (Vn - Vno)$$

and outputs the speed deviation signal.

The capacitor C1 of the integrator 7 is charged by the speed deviaition signal Vnd through the resistor R12 to effectively achieve integration and thus the integral signal voltage Vi is outputted.

The droop operation circuit 8 voltage-divides the integral signal Vi to produce the droop factor signal Va.

In the circuits of FIG. 2, if the output voltage (droop factor) of the droop operation circuit 8 is made to be zero, the constant speed characteristic is obtained. If the designated speed signal generator 6A is formed of a subtractor, the droop characteristic of increasing rotational speed with increasing load factor is obtained.

Figure 3:
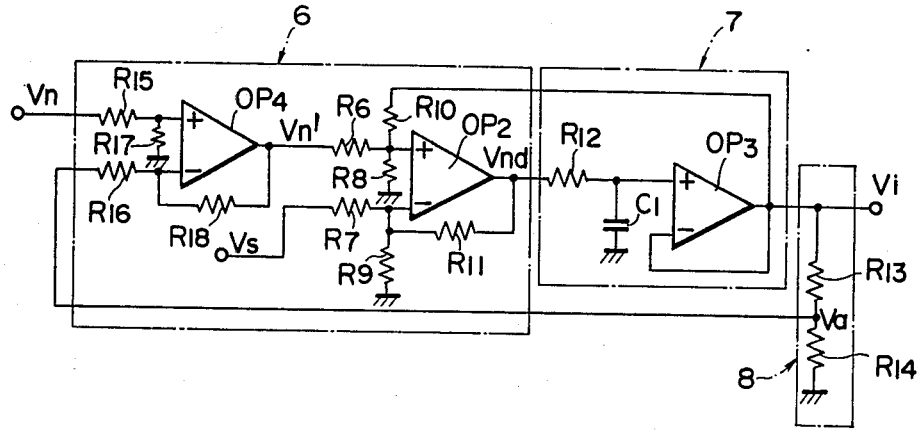

In the example of FIG. 3, the speed deviation operation circuit 6 is formed of operational amplifiers OP2 and OP4, and resistors R6-R11 and R15-R18. The integrator 7 and the droop operation circuit 8 are similar to those of FIG. 2.

In the arrangement of FIG. 3, an operation circuit formed of the operational amplifier OP4 and the resistors R15-R18 determines the signal $Vn'(=Vn-Va)$ corresponding to the difference between the speed detection signal Vn and the droop factor signal Va, while an operation circuit formed of the operational amplifier OP2 and the resistors R6-R11 determines the speed deviation signal $Vnd = Vn' - (Va + Vs)$. The rest of the operation is similar to that of the example of FIG. 2.

Figure 4:
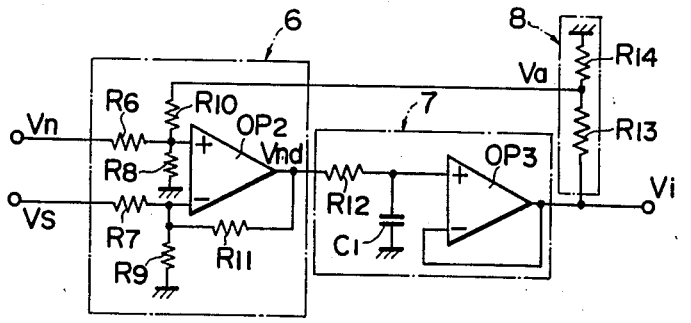

In the example of FIG. 4, the speed deviation operation circuit 6 is formed of an operational amplifier OP2 and resistors R6-R11. The rest of the arrangement is similar to that of the example of FIG. 2 or FIG. 3.

In the example of FIG. 4, the accelerator sensor 4 produces the signal Vs(=Vno) indicative of the designated rotational speed. The operational amplifier OP2 receives the designated speed signal Vno, the speed detection signal Vn and the droop factor signal Va to produce the deviation signal Vnd corresponding to (Vn+Va−Vs). The stable point of this circuit is the poin where $$Vi = Vnd = Vn + Va - Vs.$$

The system is therefore stabilized when $$Vn = Vs + (Vi - Va).$$

Figure 7:
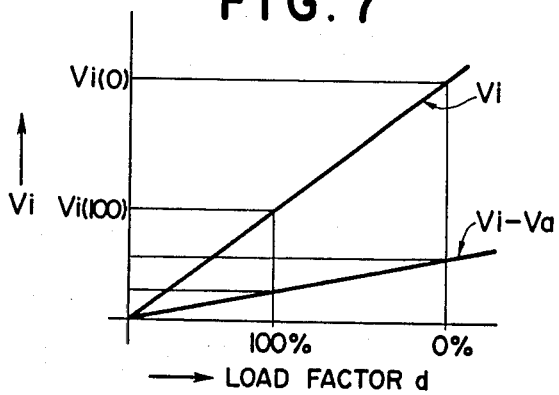
FIG. 7 is a graph showing a characteristic of the integral signal against the load factor, and a characteristic of a difference between the integral signal and the droop factor signal against the load factor.

In other words, when the circuit of FIG. 4 is used, the control system becomes stable at the rotational speed corresponding to the signal which is the sum of the accelerator position signal Vs(=Vno) and the signal (Vi−Va). The characteristic of the signal (Vi−Va) against the load factor is shown in FIG. 7. The difference in the signal (Vi−Va) between the load factor of 0% and the load factor of 100% gives the magnitude of the droop.

As has been described, according to the invention, there is provided the droop operation circuit which receives the integral signal obtained by integrating the speed deviation signal and produces the droop factor signal whose magnitude is proportional to the integral signal. The droop factor signal is fed back to the speed deviation operation circuit, which produces, as the speed deviation signal, the signal corresponding to the difference between the speed detection signal and either the sum of or the difference between the accelerator position signal and the droop factor signal. By changing the magnitude of droop factor signal, the droop factor can be freely changed. Moreover, no sensor for detecting the rack position is required, so that the structure of the governor can be simplified.

What is claimed is:

1. An electronic governor for an internal combustion engine provided with a fuel injection pump for supplying fuel to the engine and having a control rack for adjusting fuel injection amount, said electronic governor comprising, means providing an accelerator position signal Vs indicative of the desired rotatioal speed No of the internal combustion engine, a speed detector detecting the actual rotational speed N of the internal combustion engine and producing a speed detection signal Vn indicative of the rotational speed N, a speed deviation operation circuit responsive to the accelerator position signal Vs and the speed detection signal Vn for producing a speed deviation signal Vnd, an integrator for integrating the speed deviation signal, means responsive to the output of the integrator for controlling the rack, and a droop operation circuit responsive to the output of the integrator for producing a droop factor signal Va whose magnitude is proportional to the output of the integrator, said speed deviation operation circuit producing, as said speed deviation signal, a signal corresponding to the difference $Vn-(Vs+Va)$ or $Vn-(Vs-Va)$ between the speed detection signal Vn and either the sum $(Vs+Va)$ of or the difference $(Vs-Va)$ between the accelerator position signal Vs and the droop factor signal Va.

2. An electronic governor according to claim 1, wherein said speed deviation operation circuit comprises a designated speed signal generator responsive to the accelerator position signal Vs and the droop factor signal Va for producing either the sum $(Vs+Va)$ or the difference $(Vs-Va)$ between the accelerator position signal and the droop factor signal Va, and a deviation operation circuit determining the deviation of the speed detection signal from the designated speed signal, said rack control means controlling the rack to cause the deviation of the speed detection signal from the designated speed signal to be within a certain range.

3. An electronic governor according to claim 1, wherein said rack control means comprises a rack actuator electrically driven for actuating said rack, a manipulated variable operation circuit responsive to the output of the integrator for determining the manipulated variable for the rack actuator for causing the deviation of the actual rotational speed N from the designated rotational speed No to be within a certain range, and a driven circuit for driving the rack actuator in accordance with the manipulated variable determined by the manipulated variable operation circuit.

* * * * *